US006187430B1

(12) United States Patent
Mukoyoshi et al.

(10) Patent No.: US 6,187,430 B1
(45) Date of Patent: Feb. 13, 2001

(54) INK JET RECORDING SHEET AND PROCESS FOR PRODUCING SAME

(75) Inventors: Shunichiro Mukoyoshi, Ichikawa; Shinichi Asano, Tokyo; Hirokazu Sunagawa, Tokyo; Hideo Ikezawa, Tokyo, all of (JP)

(73) Assignee: Oji Paper Co., Ltd., Tokyo (JP)

( * ) Notice: Under 35 U.S.C. 154(b), the term of this patent shall be extended for 0 days.

(21) Appl. No.: 09/081,863

(22) Filed: May 21, 1998

(30) Foreign Application Priority Data

| | | |
|---|---|---|
| May 22, 1997 | (JP) | 9-132021 |
| Dec. 24, 1997 | (JP) | 9-354648 |
| Jan. 27, 1998 | (JP) | 10-013708 |

(51) Int. Cl.[7] ..... B41M 5/00; B05D 3/12

(52) U.S. Cl. ..... 428/331; 428/423.1; 428/323; 428/304.4; 347/105; 427/362; 427/379; 427/382; 427/411; 427/412.1

(58) Field of Search ..... 428/195, 206, 428/304.4, 323, 331, 423.1; 347/105, 106; 427/359, 362, 372.2, 379, 382, 411, 412.1

(56) References Cited

U.S. PATENT DOCUMENTS

| | | | | |
|---|---|---|---|---|
| 4,460,637 | * | 7/1984 | Miyamoto et al. | 428/212 |
| 4,770,934 | | 9/1988 | Yamasaki et al. | 428/331 |
| 5,275,846 | | 1/1994 | Imai et al. | 427/362 |
| 5,397,619 | * | 3/1995 | Kuroyama et al. | 428/141 |
| 5,576,088 | * | 11/1996 | Ogawa et al. | 428/327 |
| 5,612,281 | * | 3/1997 | Kobayashi et al. | 503/227 |
| 5,670,242 | * | 9/1997 | Asano et al. | 428/212 |

FOREIGN PATENT DOCUMENTS

| | | | |
|---|---|---|---|
| 0 707 977 | | 4/1996 | (EP) . |
| 0 759 365 | | 2/1997 | (EP) . |
| 0 803 374 A2 | * | 10/1997 | (EP) . |
| 7-89220 | | 4/1995 | (JP) . |

* cited by examiner

*Primary Examiner*—Marie Yamnitzky
(74) *Attorney, Agent, or Firm*—Arent Fox Kintner Plotkin & Kahn, PLLC

(57) ABSTRACT

An ink jet recording sheet having a high gloss and ink absorbing property and capable of recording clear ink images having a high and uniform color density, includes a cast-coated ink-receiving layer formed on a substrate sheet and containing fine silica particles with an average primary particle size of 3 to 40 nm and an average secondary particle size of 10 to 400 nm and a binder.

12 Claims, No Drawings

INK JET RECORDING SHEET AND PROCESS FOR PRODUCING SAME

BACKGROUND OF THE INVENTION

1. Field of the Invention

The present invention relates to an ink jet recording sheet. More particularly, the present invention relates to an ink jet recording sheet having an excellent gloss and a good ink jet recording ability.

2. Description of the Related Art

The recording system using an ink jet printer is widely utilized in various fields due to the low printing noise, the high printing speed and easy full color printing. As an ink jet recording sheet, woodfree paper sheets having a high ink-absorbing property or coated paper sheets having a porous pigment-containing coating layer formed on a substrate paper sheet, are used. However, almost all of the conventional ink jet recording sheets have a low surface gloss and thus a mat sheet-like appearance. Therefore, there is a strong demand to new type of ink jet recording sheets having a high surface gloss and an excellent appearance.

Generally, as a high gloss recording sheet, a high gloss coated sheet prepared by coating a substrate sheet surface with a plate-crystalline pigment and optionally calendering, or a cast-coated sheet prepared by press-casting a wetted coating layer formed on a substrate sheet onto a mirror-finished periphery surface of a casting drum and drying the press-casted coating layer to transfer the mirror-finished surface of the casting drum to the coating layer, are known.

The cast-coated sheets have higher surface gloss and smoothness than those of the conventional calendered coated sheets, and thus exhibit an excellent printing effect. Therefore, the conventional cast-coated sheets are mainly used for high gloss prints. When used for the ink jet printing, the conventional cast-coated sheets cause various difficulties.

Conventional cast-coated sheets are disclosed in, for example, U.S. Pat. No. 5,275,846 for T. Imai et al. In the conventional cast-coated sheets, on one hand, a film-forming substance, for example, a binder, contained in a pigment composition for forming a coating layer, serves to transfer a mirror-finished casting surface of a casting coater drum to the coating layer, and the resultant cast-coated layer has a high gloss. On other hand, the film-forming substance causes, for example, the resultant cast-coated layer to exhibit a reduced porosity and a significantly reduced absorption of the ink in the ink jet printing procedure. To enhance the ink absorption, it is important that the cast-coated layer is porous so as to enables the layer to easily absorb the ink. For this purpose, it is necessary to reduce the content of the film-forming substance in the cast-coated layer. The reduction in the content of the film-forming substance causes the white sheet gloss of the resultant cast-coated layer to decrease. As mentioned above in detail, it is practically very difficult to obtain a cast-coated layer satisfactory in both the surface gloss and ink jet printing ability.

As means for solving the above-mentioned problems, Japanese Unexamined Patent Publication No. 7-89,220, for the inventors of the present invention, discloses a cast-coated paper sheet, useful as an ink jet recording sheet, produced by forming a recording layer containing a pigment and a binder on a substrate paper sheet; coating a coating layer comprising, as a principal component, a copolymer composition produced by copolymerizing comonomers each having an ethylenically unsaturated group and having a glass transition temperature of 40° C. or more on the recording layer to form a coating liquid layer to be converted to a cast-coated layer; press casting the coating liquid layer onto a mirror-finished and heated casting surface of a drum, while the coating liquid layer is kept in a wetted condition; drying the press-casted coating liquid layer to form a cast-coated layer; and separating the casting surface from the resultant cast-coated layer. It was found that the resultant ink jet recording sheet has both a high gloss and an excellent ink-absorbing property.

However, due to significant enhancements in recording speed of ink jet recording procedure and minuteness and accuracy of the ink jet printed images, and an extensive improvement in full color printing technology, the ink jet recording sheet is strongly required to exhibit an enhanced gloss, improved sharpness and clarity, and high color density of ink images. For example, the ink jet recording sheet is required to exhibit high gloss and image quality comparative to those of the conventional silver salt-type photographic paper sheet. The above-mentioned prior art ink jet recording sheets cannot satisfy the new requirements.

SUMMARY OF THE INVENTION

An object of the present invention is to provide an ink jet recording sheet having an excellent gloss and a good ink-jet recording ability.

Another object of the present invention is to provide an ink jet recording sheet having a high ink-absorbing property in addition to the high gloss, and capable of recording ink images having high accuracy, clarity and color density.

The above-mentioned objects can be attained by the ink jet recording sheet of the present invention which comprises a substrate sheet and a cast-coated layer formed on a surface of the substrate sheet, the cast-coated layer comprising fine silica particles having an average primary particle size of 3 to 40 nm and an average secondary particle size of 10 to 400 nm. The ink jet recording sheet of the present invention optionally further comprises at least one undercoat layer comprising a pigment and a binder and arranged between the substrate sheet and the cast-coated layer.

In the ink jet recording sheet of the present invention, the cast-coating layer optionally further comprises a cationic compound.

In an embodiment of the ink jet recording sheet of the present invention, the undercoat layer comprises no cationic compound and the cast-coated layer further comprises a cationic compound.

In an embodiment of the ink jet recording sheet of the present invention, the cast-coated layer is one prepared by coating a coating liquid for the cast-coated layer on a surface of the substrate sheet; press-casting, while the resultant coating liquid layer on the substrate sheet surface is kept in a wetted condition, the coating liquid layer onto a mirror-finished peripheral surface of a casting drum; drying the press-casted coating liquid layer on the casting drum; and separating the resultant laminate from the casting drum.

In another embodiment of the ink jet recording sheet of the present invention, the cast-coated layer is one prepared by coating a coating liquid for the cast-coated layer on a surface of the substrate sheet;

drying the coating liquid layer on the substrate sheet; wetting the dried coating layer with a wetting liquid; press-casting, while the wetted coating layer is kept in a wetted condition, the wetted coating layer onto a mirror-finished peripheral surface of a casting drum; drying the press-casted coating layer on the casting drum; and separating the resultant laminate from the casting drum.

In still another embodiment of the ink jet recording sheet of the present invention, the cast-coated layer is one prepared by coating a coating liquid for the cast-coated layer on a surface of the undercoat layer formed on the substrate sheet; press-casting, while the resultant coating liquid layer on the undercoat layer surface is kept in a wetted condition, the coating liquid layer onto a mirror-finished peripheral surface of a casting drum; drying the press-casted coating liquid layer on the casting drum; and separating the resultant laminate from the casting drum.

In still another embodiment of the ink jet recording sheet of the present invention, the cast-coated layer is one prepared by coating a coating liquid for the cast-coated layer on a surface of the undercoat layer formed on the substrate sheet; drying the coating liquid layer on the undercoat layer; wetting the dried coating layer with a wetting liquid; press-casting, while the wetted coating layer is kept in a wetted condition, the wetted coating layer onto a mirror-finished peripheral surface of a casting drum; drying the press-casted coating layer on the casting drum; and separating the resultant laminate from the casting drum.

In the ink jet recording sheet of the present invention, the pigment in the undercoat layer preferably comprises at least one member selected from the group consisting of amorphous silica, alumina, and zeolite pigments.

In the ink jet recording sheet of the present invention, the undercoat layer preferably comprises a composite material of a polymer of a monomer having an ethylenically unsaturated group with a colloidal silica.

In the ink jet recording sheet of the present invention, the cast-coated layer preferably comprises a binder comprising an aqueous polyurethane resin.

In the ink jet recording sheet of the present invention, the above-mentioned aqueous polyurethane resin contained in the cast-coated layer preferably comprises a cationic aqueous polyurethane resin.

In the ink jet recording sheet of the present invention, the above-mentioned aqueous polyurethane resin contained in the cast-coated layer preferably has a glass transition temperature of 40° C. or more.

In the ink jet recording sheet of the present invention, the cast-coated layer optionally further contains a higher fatty acid amide.

In the ink jet recording sheet of the present invention, the pigment contained in the undercoat layer preferably comprises amorphous silica particles having an average secondary particle size of 2 $\mu$m to 8 $\mu$m.

The process of the present invention, for producing the ink jet recording sheet as mentioned above, comprises:

coating a coating liquid for the cast-coated layer on a surface of a substrate sheet;

semi-drying the coating liquid layer on the substrate sheet surface;

press-casting the semi-dried coating layer onto a mirror-finished peripheral surface of a casting drum;

drying the press-casted coating layer on the casting drum; and separating the resultant laminate from the casting drum.

The process of the present invention for producing the ink jet recording sheet as mentioned above comprises;

forming an undercoat layer on a surface of the substrate sheet;

coating a coating liquid for the cast-coated layer on a surface of the undercoat layer;

semi-drying the coating liquid layer on the undercoat layer surface;

press-casting the semi-dried coating layer onto a mirror-finished peripheral surface of a casting drum;

drying the press-casted coating layer on the casting drum; and separating the resultant laminate from the casting drum.

In each of the processes as mentioned above, the semi-dried coating layer contains water in an amount of 20 to 400 parts by weight per 100 parts by weight of a total solid content in the semi-dried coating layer.

DESCRIPTION OF THE PREFERRED EMBODIMENTS

In the ink jet recording sheet of the present invention, there is no specific limitation to the type, dimensions, form and color of the substrate sheet. Usually, the substrate sheet can be selected from paper sheets, for example, acid paper sheets and neutral paper sheets usable as a substrate sheets for conventional coated paper sheets. The substrate sheet may be selected from plastic resin sheets having a gas-permeability.

The paper sheets for the substrate sheet comprise, as principal component, a wood pulp and optionally a pigment. The wood pulp includes various chemical pulps, mechanical pulps and reused pulps. To adjust the paper strength and paper-forming aptitude to desired levels, the freeness of the pulps can be controlled by a beater. In the wood pulps usable for the present invention, there is no limitation to the freeness of the pulps. Usually, the wood pulps have a Canadian standard freeness (CSF) of 250 to 550 ml determined in accordance with Japanese Industrial Standard (JIS) P 8121.

The pigment is used for the purpose of imparting an opaqueness to the paper sheet and/or controlling an ink-absorbing property of the paper sheet.

For the pigment, calcium carbonate, calcined kaolin, silica and titanium dioxide are used. In this case, the content of the pigment in the paper sheet is preferably 1 to 20% by weight. When the pigment content is too high, the mechanical strength of the resultant paper sheet may be unsatisfactory.

The paper sheet for the substrate sheet optionally contains an additive, for example, sizing agent, fixing agent, paper-strength increasing agent, cation-modifying agent, yield-increasing agent, dye and/or fluorescent brightening agent.

Further, in a size-press step on a paper-forming machine, a size-press agent, for example, starch, polyvinyl alcohol or a cationic resin, is coated on or impregnated in the paper sheet, to control the surface strength and degree of sizing of the paper sheet. The degree of sizing is preferably about 1 to 200 seconds. If the degree of sizing is too low, the resultant paper sheet may cause a difficulty in the coating procedure due to formation of wrinkles, and thus the production of a coated paper sheet may be difficult. If the degree of sizing is too high, the resultant paper sheet may exhibit a low ink-absorbing property, and the resultant coated paper sheet may be disadvantages in that when ink-jet printed, a curling and/or cockling phenomenon occurs. The substrate sheet for the present invention preferably has a basis weight of 20 to 400 g/m$^2$ which is merely representative but not exclusive.

In the ink jet recording sheet of the present invention, the gas-permeable resin sheet usable for the substrate sheet includes transparent or opaque resin (plastic) films or sheets having a plurality of perforations formed by a mechanical treatment, pigment-containing resin film sheets oriented after shaping to form a plurality of pores (voids), and porous resin films or sheets produced by shaping a mixture of a resin with a solvent-soluble pigment or compound into films or sheets, and treating the films or sheets with a solvent to dissolve away the solvent-soluble pigment or compound from the films or sheets.

In the ink jet recording sheet of the present invention, a cast-coated layer may be formed directly on a surface of a substrate. Preferably, an undercoat layer is formed on a surface of the substrate sheet and then a cast-coated layer is formed on the undercoat layer, to enhance the ink-absorbing rate and ink-absorbing capacity of the resultant ink jet recording sheet. The undercoat layer to be formed on the substrate sheet comprises, as principal components, a pigment and a binder. The pigment in the undercoat layer may comprise at least one member selected from kaolin, clay, calcined clay, amorphous silica, synthetic amorphous silica, zinc oxide, aluminum oxide, aluminum hydroxide, calcium carbonate, satin white, aluminum silicate, alumina, colloidal silica, zeolites, synthetic zeolites, sepiolite, smectate, synthetic smectite, magnesium silicate, magnesium carbonate, magnesium oxide, diatomaceous earth, styrene polymer plastic pigments, hydrotalcite, urea resin plastic pigments, and benzoguanamine resin plastic pigments, which are conventional pigments usable for common coated paper sheets. Among the above-mentioned pigments, the amorphous silica, alumina and zeolites which have a high ink-absorbing property, are preferably used as a main component of the pigment.

In a preferred embodiment, the pigment for the undercoat layer comprises silica particles having an average secondary particle size of 2 $\mu$m to 8 $\mu$m. If the size is less than 2 $\mu$m, the resultant undercoat layer may exhibit a low ink-absorbing rate, and thus when the ink is applied in a large amount, the applied ink may become blotted. When the average secondary particle size is more than 8 $\mu$m, a surface coating layer formed on the resultant undercoat layer may have an unsatisfactory smoothness, and an insufficient gloss, and exhibit an unsatisfactory appearance. When the surface coating layer is formed on the undercoat layer having a low smoothness by a cast-coating method which will be explained later, the resultant cast-coated layer may exhibit an insufficient adhesion to a casting surface, for example, casting drum surface, and may have a roughened surface, an uneven gloss and a poor appearance. The above-mentioned amorphous silica contributes to enhancing the smoothness and gloss and the quality of ink images and thus the pigment in the undercoat layer preferably contains the amorphous silica in an amount of 50% by weight or more based on the total weight of the pigment.

The binder for the undercoat layer preferably comprises at least one member selected from proteins, for example, casein, soybean protein and synthetic proteins, starch and starch derivatives, for example, oxidized starch, polyvinyl alcohol and polyvinyl alcohol derivatives, for example, cation-modified polyvinyl alcohols and silyl-modified polyvinyl alcohol, cellulose derivatives, for example, carboxymethyl cellulose and methyl cellulose, conjugated diene polymer latices, for example, styrenebutadiene copolymer and methyl methacrylatebutadiene copolymer latices, acrylic polymer latices, and vinyl polymer latices, for example, ethylenevinyl acetate copolymer latices, which are conventional binder materials well-known for the coated paper sheets.

The contents of pigment and the binder in the undercoat layer are variable in response to the types of the pigment and the binder, and usually the binder is used in an amount of 1 to 100 parts by weight, preferably 2 to 50 parts by weight, per 100 parts by weight of the pigment.

The undercoat layer optionally contains at least one additive selected from, for example, dispersing agents, viscosity-modifiers, antifoaming agents, anti-static agents, and preservatives which are usually used for coated paper sheets. The undercoat layer may contain a fluorescent dye and/or a coloring material.

In the undercoat layer, a cationic compound is optionally contained for the purpose of fixing the dye component in the ink jet recording ink. However, the dye component should be fixed in the cast-coated layer formed on the undercoat layer, to increase the color density of the ink images formed in the ink-receiving layer including the cast-coated layer and the undercoat layer. Therefore, the content of the cationic compound in the cast-coated layer is preferably higher than that in the undercoat layer. More preferably, the cationic compound is contained only in the cast-coated layer and the undercoat layer is substantially free from the cationic compound. The expression "substantially free" means that the undercoat layer may contain a very small amount of a cationic surfactant which merely serves as a surface active additive but not as a dye-fixing agent. When the cationic compound is added only to the cast-coated layer and is substantially not contained in the undercoat layer, the resultant ink jet recording sheet surface exhibits an excellent gloss.

When the undercoat layer contains a composite product of a colloidal silica with a polymer resin produced by polymerizing a monomer having ethylenically unsaturated groups, the cast-coated layer formed on the undercoat layer exhibits an enhanced gloss. The reasons for the enhanced gloss are not completely clear. However, it is assumed that the presence of the composite product in the undercoat layer causes the penetration of a coating liquid for the cast-coated layer into the undercoat layer to be restricted, whereas the ink-absorbing property of the undercoated layer is not affected by the composite product. Also, it has been unexpectedly found that the presence of the composite product in the undercoat layer causes the releasing property of cast-coated layer formed on a casting surface, for example, a casting drum surface, from the casting surface to be enhanced. The reasons of the enhancement in the releasing property is not yet known.

The polymer resin produced by polymerizing a monomer having ethylenically unsaturated groups is preferably selected from polymers of at least one ethylenically unsaturated monomer selected from, for example, acrylic acid esters having an alkyl group with 1 to 18 carbon atoms, for example, methyl acrylate, ethyl acrylate, butyl acrylate, 2-ethylhexyl acrylate, lauryl acrylate, 2-hydroxyethyl acrylate and glycidyl acrylate; methacrylic acid esters having an alkyl group with 1 to 18 carbon atoms, for example, methyl methacrylate, ethyl methacrylate, 2-hydroxyethyl methacrylate, 2-hydroxypropyl methacrylate and glycidyl methacrylate; and styrene, $\alpha$-methylstyrene, vinyltoluene, acrylonitrile, vinyl chloride, vinylidene chloride, vinyl acetate, vinyl propionate, acrylamide, N-methylol acrylamide, ethylene and butadiene. The polymers include copolymers of two or more ethylenically unsaturated monomers and substituted derivatives of the polymers and copolymers. The substituted derivatives include, for example, carboxyl-substituted derivatives of the polymers or copolymers, and modified carboxyl-substituted derivatives having a reactivity with alkalis.

The production of the composite product of the colloidal silica with the polymers of the ethylenically unsaturated monomers is carried out, for example, by polymerizing the ethylenically unsaturated monomers in the presence of a silane coupling agent and a colloidal silica to form a composite product of the resultant polymer with the colloidal silica particles connected to each other through Si—O—R bondings wherein R represents the connected polymer. Optionally, the polymer resin modified with silanol groups is reacted with the colloidal silica so as to provide a composite product in which the polymer is connected to the colloidal silica particles through Si—O—R bondings wherein R represents the bonded polymer.

The polymer component in the composite product preferably has a glass transition temperature (Tg) of 40° C. or more, preferably 50 to 100° C. When the Tg is too low, when the coating liquid layer for the undercoat layer is coated on the substrate sheet and dried, the film-formation of the coating layer progresses to too high an extent, the resultant undercoat layer may exhibit an unsatisfactory ink-absorbing rate and the ink penetrated into the undercoat layer may be blotted. When the Tg is more than 40° C., the cast-coated layer formed on the under-coat layer and cast on a casting drum surface unexpectedly exhibits an enhanced releasing property from the casting surface. The reasons of the enhancement of the releasing property are not yet known.

The coating liquid for the undercoat layer containing the above-mentioned components preferably has a total solid content of about 5 to 50% by weight, and is coated in a dry weight of 2 to 100 g/m$^2$, preferably 5 to 50 g/m$^2$ more preferably 10 to 20 g/m$^2$ on a surface of a substrate sheet. If the coating amount of the undercoat layer is too small, the resultant undercoat layer may exhibit an unsatisfactory ink absorbing property and the cast-coated layer formed on the undercoat layer may exhibit an unsatisfactory gloss. If the coating amount of the undercoat layer is too large, the color density of the printed ink images may be low, and the mechanical strength of the undercoat layer may be poor and thus the undercoat layer may be easily damaged and/or powdered. The coating liquid for the undercoat layer can be coated on a surface of a substrate sheet by a conventional coating device, for example, blade coater, air knife coater, roll coater, brush coater, champlex coater, bar coater, lip coater, die coater, gravure coater or curtain coater. The coated undercoat layer is dried and then, optionally, is subjected to a smoothing treatment by a super calender or by brushing.

In the ink jet recording sheet of the present invention, a cast-coated layer is formed on a surface of a substrate sheet or on an undercoat layer formed on a surface of the substrate sheet.

The cast-coated layer comprises, as a principal component, specific fine silica particles and optionally a binder. The specific fine silica particles will be explained below.

There is no limitation to the preparation method of the specific fine silica particles usable for the present invention. For example, the specific fine silica particles can be prepared by applying a strong pulverizing force to trade synthetic amorphous silica particles having an average secondary particle size of, for example, several micrometers, by mechanical means, to decrease the average secondary particle size. The mechanical means for this purpose can be selected from ultrasonic homogenizers, pressure-type homogenizers, high speed rotation mills, roller mills, container-driving medium mills, medium-agitation mills, jet mills, and sand grinders. The fine silica particles pulverized as mentioned above, are usually in an aqueous dispersion (slurry or colloidal solution) having a solid content of 5 to 20% by weight.

In the present invention, the term "average particle size" refers to an average of particle sizes measured by an electron microscope (SEM or TEM). Namely, in the measurement of the particle sizes, an electron microscopic photograph of fine particles is taken at a magnification of 10,000 to 400,000, martin size of the particles located within a unit area of 5 cm×5 cm are measured and the measured data is averaged. This measurement method is disclosed in "FINE PARTICLE HANDBOOK", page 52, published by ASAKURA SHOTEN, 1991.

The silica fine particles usable for the present invention mainly comprise silica secondary particles and the average secondary particle size of the silica particles is adjusted to 10 nm or more, but not more than 400 nm, preferably 10 nm or more but not more than 300 nm, more preferably 15 nm or more but not more than 150 nm, still more preferably 20 nm or more but not more than 100 nm. When the average secondary particle size of the silica particles is more than 400 nm, the resultant cast-coated layer has an unsatisfactory transparency and thus the coloring effect of the dye fixed in the cast-coated layer is low, and the color density of the ink images on the cast-coated layer is unsatisfactory. When silica fine particles having a very small average secondary particle size are employed, the resultant cast-coated layer exhibits an unsatisfactory ink-absorbing property, and thus desired ink images having a high grade and quality cannot be obtained.

The average primary particle size of the fine silica particles should be controlled to 3 nm or more but not more than 40 nm, preferably 5 nm or more but not more than 30 nm, more preferably 7 nm or more but not more than 20 nm. If the average primary particle size is less than 3 nm, gaps formed between the primary particles of the fine silica particles is significantly small, and the resultant cast-coated layer exhibits an unsatisfactory absorbing property of the ink or the solvent contained in the ink, and thus the resultant ink images cannot exhibit a desired high grade and quality. If the average primary particle size is more than 40 nm, the resultant secondary particles each consisting essentially of a plurality of primary particles agglomerated with each other have a large size, the resultant cast-coated layer exhibits an unsatisfactory transparency, the coloring effect of the dye in the ink fixed in the cast-coated layer is insufficient, and thus the printed ink images have cannot have a desired high color density.

In the cast-coated layer, the specific fine silica particles can be employed together with an additional pigment particles, for example, the same pigment particles as those usable for the undercoat layer, as long as the additional pigment particles do not affect the effect of the present invention, preferably, the additional pigment particles have an average particle size of 500 nm or less, more preferably the same as or smaller than the average secondary particle size of the fine silica particles.

In the cast-coated layer, the proportion of the fine silica particles is preferably 50% or more based on the total weight of the fine silica particles and the additional pigment particles, to maintain the transparency of the cast-coated layer at a satisfactory level. When the proportion of the fine silica particles is less than 50% based on the total pigments, the transparency of the resultant cast-coated layer may be insufficient and the resultant ink images may not exhibit a desired high color density and grade.

The binder for the cast-coated layer preferably comprises at least one member selected from water-soluble polymeric materials, for example, polyvinyl alcohol, modified polyvinyl alcohols, for example, cation-modified polyvinyl alcohols, and silyl-modified polyvinyl alcohols, polyvinyl pyrrolidone, casein, soybean protein, synthetic proteins, starch, and cellulose derivatives, for example, carboxymethyl cellulose, methyl cellulose; and latices of water-dispersible polymers, for example, conjugated diene polymer latices, for example, styrene-butadiene copolymer and methyl methacrylate-butadiene copolymer latices and vinyl copolymer latices, for example, styrene-vinyl acetate copolymer latices, aqueous acrylic resins, aqueous polyurethane resins and aqueous polyester resins and the others well-known and employed in the conventional coated paper sheets. These polymeric materials for the binder may be employed alone or in a mixture of two or more thereof.

Among the above-mentioned polymeric materials, the aqueous polyurethane resins are preferably employed as at least a part of the binder.

In an embodiment, the ink jet recording sheet of the present invention comprises a substrate sheet, a cast-coated layer formed on the substrate sheet comprising a pigment and a binder and optionally at least one undercoat layer arranged between the substrate sheet and the cast-coated layer and comprising a pigment and a binder, the pigment contained in the cast-coated layer comprising fine silica particles having an average primary particle size of 3 to 40 nm and an average secondary particle size of 10 to 400 nm, preferably 10 to 300 nm, and the binder contained in the cast-coated layer comprising an aqueous polyurethane resin.

In this embodiment, the binder for the cast-coated layer comprises an aqueous polyurethane resin. When the aqueous polymethane resin is contained, the resultant cast-coated layer exhibits an excellent releasing property. Further, the resultant ink jet recording sheet exhibits excellent ink-absorbing property, color density of ink images, water resistance, surface strength, and gloss. The aqueous polyurethane resins are referred to as urethane emulsions, urethane latices and polyurethane latices.

The polyurethane resins are obtained by a reaction of a polyisocyanate compound with an active hydrogen-containing compound and are defined as polymeric compounds having relatively large numbers of urethane structures and urea structures.

The polyisocyanate compounds usable for the production of the aqueous polyurethane are not limited to specific type of compounds and include aromatic polyisocyanate compounds, for example, tolylene diisocyanate and 4,4'-diphenylmethane-diisocyanate, and aliphatic and cycloaliphatic polyisocyanate compounds, for example, hexamethylene diisocyanate and isophorone diisocyanate.

The active hydrogen-containing compounds for the production of the aqueous polyurethane resins generally include compounds having a hydroxyl group or an amino group. The active hydrogen-containing compounds having a high molecular weight include polyesterdiols, polyetherdiols and polycarbonatediols. The active hydrogen-containing compounds having a low molecular weight include glycol compounds, for example, ethyleneglycol, 1,4-butanediol and 1,6-hexanediol, and diamine compounds, for example, isopropyldiamine and hexamethylenediamine.

The aqueous polyurethane resins are dispersed or emulsified in a fine particle form in an aqueous medium. The particles have a particle size of about 0.001 to 20 $\mu$m. The aqueous polyurethane resins are in the state of a transparent solution, a semi-transparent colloidal dispersion or milky emulsion. In the present invention, the aqueous polyurethane resins may be any of the above-mentioned states.

The aqueous polyurethane resins are classified into forcedly emulsified resins prepared by forcedly emulsifying the resins in the presence of an emulsifying agent by a high mechanical shearing force; self-emulsifying resins in which hydrophilic groups, for example, ionic groups are introduced into molecular chains thereof to impart a high hydrophilicity to the resins and to cause the resin to be stably dispersed in water without assistance of an emulsifying agent; and solution resins which are dissolved in water. Among them, the self-emulsifying resins can form a film having high gloss and water resistance, and are preferably used for the present invention. The self-emulsifying aqueous polymethane resins are classified, in accordance with the type of the hydrophilic groups introduced thereinto, into a cationic type in which an amino group or other cationic group is introduced; an anionic type in which a carboxylic group and/or a sulfonic acid group is introduced; and a nonionic type in which a polyethyleneglycol group, etc. is introduced. Among them, a cationic aqueous polyurethane resins produced by introducing cationic groups, for example, tert-amino groups into the resin molecules, and neutralizing or converting the resultant cationic compounds into a quaternary salt thereof with an acid, are preferably employed.

When the aqueous polyurethane resins are cationic, the cationic resins have a good ink-fixing property and are useful for forming a cast-coated layer having excellent ink-absorbing property and capable of recording ink images having a high color density. When a cationic compound is added, as a aqueous ink-fixing agent, into the cast-coated layer, the aqueous cationic polyurethane resins exhibit a high compatibility with the cationic compound.

When the aqueous polyurethane resins have a glass transition temperature of 40° C. or more, the resultant cast-coated layer has an excellent releasing property from the casting surface such as a casting drum surface. Preferably, the aqueous polyurethane resin has a glass transition temperature of 60° C. or more. There is no specific upper limit of the glass transition temperature of the aqueous polymethane resins. Usually, the glass transition temperature is not more than 150° C.

In the cast-coated layer of the present invention, the content of the aqueous polyurethane resin is preferably 50% or more based on the total weight of the binder, to ensure the target effect of the present invention.

The content of the binder in the cast-coated layer is preferably 1 to 200 parts by weight, more preferably 10 to 100 parts, per 100 parts by weight of the pigment. If the content of the binder is too small, the resultant cast-coated layer may exhibit an insufficient mechanical strength for practical use and the surface may be easily damaged or powdered. If the binder content is too large, the resultant cast-coated layer may exhibit an unsatisfactory ink-absorbing property and thus a poor ink jet recording ability.

In the cast-coated layer, a cationic compound is preferably contained for the purpose of fixing the dye component in the ink. The cationic compound may be mixed with the fine silica particles. In this mixing, since the fine silica particles are generally anionic, the addition of the cationic compound may cause the fine silica particles to be agglomerated and thus the particle size thereof may increase. In this case, when trade amorphous silica particles (which usually have an average secondary particle size of several micrometers) are pulverized into fine particles and dispersed in a medium by applying a strong shearing force with mechanical means, non-pulverization treated amorphous silica particles are subjected, together with a cationic compound, to the mechanical pulverize-dispersing procedure, or trade amorphous silica particles are pulverized and then mixed with a cationic compound to allow the particles to agglomerate with each other, and the resultant mixture to exhibit an increased viscosity, the mixture is again subjected to the mechanical pulverize-dispersing procedure to adjust the average secondary particle size thereof to the above-mentioned specific level. The pulverize-dispersing procedure does not change the primary particle size of the silica particles.

The cationic compound includes a cationic resin and low molecular weight cationic compound, for example, a cationic surfactant compound. To increase the color density of the ink images, the cationic resin is advantageously employed in the state of an aqueous solution or dispersion. The cationic resin may be employed as a cationic organic pigment which is produced by insolubilizing the resin by means of, for example, cross-linking, and is in the form of fine particles. The cationic organic pigment may be produced by copolymerizing a cationic monomer with a polyfunctional commonomer which serves as a cross-linking agent, or by cross-linking a cationic resin having reactive groups, for example, hydroxyl, carboxyl, amino and/or acetoacetyl groups, optionally in the presence of a cross-linking agent, by means of heating or irradiation. Sometimes the cationic compound, and particularly the cationic resin, serves as a binder.

The cationic resins include the followings.

1) Polyalkylenepolyamines, for example, polyethylenepolyamines and polypropylenepolyamines, and derivatives thereof 2) Acrylic resins having secondary amino groups, tertiary amino groups, and/or quaternary ammonium salt groups 3) Polyvinylamines and polyvinylamidines 4) Cationic dicyan resins, for example, dicyandiamide-formaldehyde poly-condensation products 5) Cationic polyamine resins, for example, dicyandiamide-diethylenetriamine polycondensation products 6) Epichlorohydrin-dimethylamine addition-polymerization products 7) Dimethyldiallyl ammonium chloride-$SO_2$ copolymerization products 8) Diallylamine salt-$SO_2$ copolymerization products 9) Dimethyldiallyl ammonium chloride polymerization products 10) Allylamine salt polymers 11) Dialkylaminoethyl (meth)acrylate quaternary salt polymers and 12) Acrylamide-diallylamine salt copolymerization products The cationic compound also exhibits an effect of enhancing the water-resistance of the printed ink images.

The cationic compound is preferably employed in an amount of 1 to 100 parts by weight, more preferably 5 to 50 parts by weight, per 100 parts by weight of the pigment, to form the cast-coated layer. When the content of the cationic compound is too low, the color density-enhancing effect on the ink images may be insufficient. When the cationic compound is employed in too a high content, the color density of the ink images may be low and the ink images may blot.

In the cast-coated layer, a releasing agent which is conventionally used in the production of the usual coated paper sheets or cast-coated paper sheets for printing, is preferably contained.

The releasing agent for the cast-coated layer preferably comprises at least one member selected from higher fatty acid amides, for example, stearic acid amide; polyolelin waxes, for example, polyethylene waxes and polypropylene waxes; alkali metal and ammonium salts of higher fatty acids, for example, calcium stearate, zinc stearate, potassium oleate, and ammonium oleate; lecithin; and silicone compounds, for example, silicone oils and silicone waxes. Among the above-mentioned compounds, the higher fatty acid amides are preferably employed.

In the above-mentioned preferable embodiment of the ink jet recording sheet of the present invention, the cast-coated layer optionally further comprises a higher fatty acid amide. The higher fatty acid amide is preferably selected from acid amides of higher fatty acids having 12 to 34 carbon atoms, for example, lauric acid, tridecylic acid, myristic acid, pentadecylic acid, stearic acid, nonadecanoic acid, arachic acid, behenic acid, lignoceric acid, cerotic acid, heptacosanoic acid, montanic acid, melissic acid, lacceric acid, oleic acid, elaidlc acid, cetoleic acid, erucic acid, brassidic acid, linoleic acid, linolenic acid, arachidonic acid, propiolic acid and stearolic acid. Among the above-mentioned higher fatty acid amides, the stearic acid amide and oleic acid amide are more preferable to obtain a desired performance of the ink jet recording sheet, for example, a high resistance to ink image-blotting, a high enhancement in color density of ink images, a high enhancement in gloss and a good releasing property from the casting surface, for example, a casting drum.

When a coating liquid for the cast-coated layer is coated and dried on a casting drum surface (a mirror-finished surface of a metal, plastic or glass drum), mirror-finished surface of a metal plate, or smooth surface of a plastic sheet or film or glass plate, and the dried cast-coated layer is separated from the casting surface, the higher fatty acid amides contribute to significantly enhancing the releasing property of the resultant cast-coated layer from the casting surface. If the releasing property of the cast-coated layer from the casting surface is insufficient, the resultant cast-coated layer exhibits a low and uneven gloss, and sometimes the cast-coated layer cannot be separated from the casting surface. The inventors of the present invention have studied materials contributory to enhancing the releasing property of the cast-coated layer containing very fine silica particles and a binder as principal components from the casting surface, and found that the higher fatty acid amides contribute to significantly enhancing the releasing property and the resistance to ink image-blotting. Particularly, when the cationic compound is contained in the cast-coated layer, the resultant cast-coated layer exhibits a significantly enhanced releasing property and a resistance to ink image-blotting.

The releasing agent is preferably contained in a content of 0.1 to 50 parts by weight, more preferably 0.5 to 30 parts by weight, still more preferably 1 to 20 parts by weight, per 100 parts by weight of the pigment, in the cast-coated layer. If the releasing agent content is too low, the resultant releasing property-enhancing effect may be unsatisfactory. Also, if the releasing agent content is too high, the resultant cast-coated layer may exhibit an unsatisfactory gloss, an undesirably increased ink-repellency and a low color density of ink images.

The cast-coating method is referred to as a method in which a coating liquid is dried on a mirror-finished peripheral surface made of a metal, plastic resin or glass, of a casting drum, or a mirror-finished surface of a metal plate, plastic resin film or sheet, or glass plate, to transfer the mirror-finished casting surface to the cast-coated layer; and the resultant dried cast-coated layer is separated from the casting surface, to obtain a cast-coated layer surface having high smoothness and gloss.

In an method of forming a cast-coated layer, the coating liquid for the cast-coated layer is coated on a substrate sheet surface or an undercoat layer surface formed on the substrate sheet, the resultant coating liquid layer is press-casted onto a heated casting surface, for example, the mirror-finished surface of the casting drum, while the coating liquid layer is kept in a wetted condition. This method is referred to as a wet-casting method. In another method, the coated coating liquid layer is dried, the dried coating layer is wetted with a wetting agent, for example, water, the wetted coating layer is press-casted onto a heated casting surface, for example, a heated mirror-finished casting surface, while the wetted coating layer is kept in a wetted condition, and the dried cast-coated layer is separated from the casting surface. This method is referred to as a rewetting casting method. Generally, the wet casting method is advantageous in a high gloss and ink-absorbing property of the resultant cast-coated layer. However, the rewetting casting method is advantageous in a high productivity.

The cast-coated layer of the present invention can be formed by still another casting method in which a coating liquid for the cast-coated layer is directly coated on a heated casting surface, for example, a heated mirror-finished surface of a casting drum, a substrate sheet or an undercoat layer formed on a substrate sheet is laminated and bonded to the coating liquid layer on the casting surface under pressure, and the resultant laminate is separated from the casting surface. This method is referred to as a pre-casting method.

In the cast-coating procedure, the heating temperature is preferably 40 to 200° C., more preferably 70 to 150° C. There is no limitation to the casting time for which the cast-coated layer is retained in contact with the casting surface. Usually, the casting time is about 1 to 60 seconds.

The casting smooth surface, for example, a mirror-finished surface preferably has a surface roughness Ra of 0.5 $\mu$m or less, more preferably 0.05 $\mu$m or less, determined in accordance with Japanese Industrial standard (JIS) B 0601.

In still another casting method, a coating liquid for the cast-coated layer is coated on a substrate sheet surface or a surface of an undercoat layer formed on the substrate sheet surface, the coated coating liquid layer is semi-dried and press-cast onto a heated casting surface, for example, a heated mirror-finished surface of a casting drum, while the semi-dried coating layer is kept in a semi-dried condition, the cast coating layer is dried on the casting surface, and the resultant laminate is separated from the casting surface. This method is particularly advantageous in that the resultant cast-coated layer has a high uniformity and a high gloss and can record ink images having a high color density. In this casting method, the semi-dried coating layer exhibits substantially no fluidity and contains a certain amount of water. The content of water in the semi-dried coating layer is preferably controlled to 20 to 400%, more preferably 50 to 200%, based on the bone-dry weight of the coating layer. In other words, the water content in semi-dried coating layer is preferably 20 to 400 parts by weight, more preferably 50 to 200 parts by weight, per 100 parts by bone-dry weight of the coating layer. When the water content is too low, the transfer of the mirror-finished casting surface to the cast-coated layer may be insufficient, and the resultant cast-coated layer may exhibit an unsatisfactory gloss. When the water content is too high, the coating layer press-casted onto the casting surface may be easily crushed and thus the resultant cast-coated layer may have an insufficient amount and exhibit a low uniformity, and unsatisfactory color density of ink images and gloss. Also, sometimes, the coating layer may adhere to the casting surface, and after separated, the resultant cast-coated layer may exhibit a poor gloss, the casting surface may be soiled with remaining portions of the coating layer, and thus the casting procedure may not able to continue.

In a casting procedure in which a coating liquid for a cast-coated layer is coated on a surface of a substrate sheet or of an undercoat layer formed on the substrate sheet, the resultant coating liquid layer is press-cast onto a heated casting surface, for example, a heated mirror-finished casting drum surface, while the coating liquid layer is kept in a wetted condition, and the casted coating liquid layer is dried to form a cast-coated layer, a procedure for enhancing non-mobility of the coating liquid layer may be applied, to form a cast-coated layer having a high uniformity and a sufficient coating amount.

The non-mobility-enhancement can be attained by a method (1) in which a gelatinizing agent which promotes the non-mobility of the coating liquid for the cast-coated layer is previously contained in the substrate sheet or the undercoat layer; or by a method (2) in which a gelatinizing agent which promotes the non-mobility of the cast-coating liquid for the cast-coated layer is previously coated on or impregnated in the substrate sheet or the undercoat layer; or by a method (3) in which a coating liquid for a cast-coated layer is coated on a substrate sheet or an undercoat layer, the resultant coating liquid layer is coated or impregnated with a gelatinizing agent which promotes the non-mobility of the coating liquid layer; or a method (4) in which a gelatinizing agent which promotes, during a stage of drying the coating liquid layer the non-mobility of the coating liquid layer is mixed into the coating liquid.

The gelatinizing agent usable for the above-mentioned purpose comprises at least one member selected from, for example, boric acid, formic acid, salts of the above-mentioned acids, aldehyde compounds and epoxy compounds which serve as cross-linking agent for the binder contained in the coating liquid for the cast-coated layer.

It is possible that the same composition as the coating liquid for the cast-coated layer is optionally coated on a substrate sheet or an undercoat layer and dried or semi-dried; the resultant coating layer is coated with the coating liquid for the cast-coated layer; and the resultant coating liquid layer is press-casted onto a casting surface, for example, a casting drum surface, and then dried to form a cast-coated layer.

To control whiteness, viscosity and fludity of the coating liquid for the cast-coated layer, an additive comprising at least one member selected from pigments, anti-foaming agents, coloring materials, fluorescent brightening agents, anti-statics, preservatives, dispersing agents and viscosity-modifiers which are usable for conventional printing coated paper sheets and ink jet recording sheets, may be contained in the coating liquid.

The coating liquid for the cast-coated layer can be coated on the substrate sheet or undercoat layer by a conventional coater, for example, a blade coater, air knife coater, roll coater, brush coater, champlex coater, bar coater, gravure coater, lip coater, die coater or curtain coater.

The cast-coated layer is preferably formed in a dry solid weight of 1 to 30 g/m$^2$, more preferably 1.5 to 20 g/m$^2$, still more preferably 3 to 15 g/m$^2$. If the cast-coated layer amount is less than 1 g/m$^2$, the resultant cast-coated layer may have an unsatisfactory gloss and color density of ink images. If the amount is more than 30 g/m$^2$, the effect of the cast-coated layer is saturated, an economical disadvantage may occur, and a coating operation efficiency may decrease.

After the cast-coating procedure is completed, the resultant cast-coated layer may be smoothed by, for example, a super calender.

Reasons of obtaining an ink jet recording sheet having excellent gloss and ink jet recording ability in accordance with the present invention are as follows.

The reasons of enhancing the grade of the printed ink images are as follows.

By using fine silica particles having a small average secondary particle size for the formation of the cast-coated layer, the resultant cast-coated layer exhibits an enhanced transparency, and thus does not hinder the color formation of the ink supported on the cast-coated layer, and, as a result, the grade (color density) of the ink images is enhanced.

Further, when a cationic compound is contained in the cast-coated layer, the dye component in the ink is selectively fixed in the cast-coated layer, and thus the above-mentioned effects are further enhanced. Also, the undercoat layer contributes to increasing the ink-absorbing rate. When the cationic compound is contained in the cast-coated layer and substantially no cationic compound is contained in the undercoat layer, the cast-coated layer selectively fixes the dye component of the ink, and the undercoat layer rapidly absorbs the solvent component of the ink. Therefore, the resultant ink jet recording sheet exhibits an excellent ink absorbing property and the printed ink images exhibit a high color density.

The reasons of the enhancement in gloss are as follows. Since the cast-coated layer is formed by a casting method using a casting surface, for example, a casting drum surface, and a high smoothness of the casting surface is transferred to the surface of the cast-coated layer and the resultant cast-coated layer has a high gloss. Further, since the silica particles contained in the cast-coated layer have a very small average secondary particle size, the surface of the resultant cast-coated layer exhibits a reduced degree of diffused reflection of light and thus an enhanced gloss.

In the ink jet recording sheet of the present invention, the cast-coated layer preferably has a degree of gloss of 30% or more, more preferably 35% or more, still more preferably 50% or more.

In an embodiment of the ink jet recording sheet of the present invention in which an aqueous polyurethane resin is contained, as a binder, in the cast-coated layer, the aqueous polyurethane resin exhibits a high bonding activity to the fine silica particles, and thus can be employed in a reduced content in the cast-coated layer. Accordingly, in the present invention, the porosity of the cast-coated layer is not decreased by an excessively high content of the binder resin, the resultant cast-coated layer has excellent ink absorbing property and mechanical strength. Also, the aqueous polyurethane resin contributes to enhancing the gloss of the cast-coated layer.

Further, when a higher fatty acid amide is contained in the cast-coated layer, the diffusion of the ink in the resultant cast-coated layer is adequately restricted and thus, as a result, clear ink images free from blotting can be obtained. Also, the higher fatty acid amide contributes to preventing adhesion of the cast-coated layer to a casting surface, for example, a casting drum surface, and to increasing the gloss of the cast-coated layer surface.

When a cationic compound is contained in the cast-coated layer, the higher fatty acid amide can be more uniformly dispersed in the cast-coated layer, and thus the effect of the higher fatty acid amide-added to the cast-coated layer is significantly enhanced.

Also, when the cationic compound is contained in the cast-coated layer, the dye component of the ink is selectively fixed in the cast-coated layer, and thus the grade (color density) of the ink images can be significantly enhanced.

EXAMPLES

The present invention will be further explained by the following examples which are merely representative and do not restrict the scope of the present invention in any way.

In the examples and comparative examples, "%" and "part" are—% by weight—and—part by weight—, unless otherwise specifically indicated.

Production of support sheet

The support sheet for the examples and comparative examples was produced by the following procedures.

An aqueous pulp slurry containing 100 parts of a wood pulp (LBKP, freeness (CSF): 500 ml) 10 parts of calcined kaolin (trademark: Ansilex, made by ENGELHARD CORP.), 0.05 part of a trade sizing agent, 1.5 parts of aluminum sulfate, 0.5 part of wet paper strength-enhancing agent and 0.75 part of starch, was fed to a cylinder paper machine and converted to a paper sheet having a basis weight of 120 g/m$^2$. This paper sheet had a stöckigt sizing degree of 10 seconds. In all of the following examples and comparative example, this paper sheet was employed as a substrate sheet.

Preparation of fine Silica Particles

[Fine silica particles A]

An aqueous dispersion of synthetic amorphous silica particles (trademark: FINESIL X-45, made by TOKUYAMA K.K.) having an average secondary particle size of 4.5 $\mu$m and an average primary particle size of 15 nm, was subjected to repeated pulverizing and dispersing operations in a pressure type homogenizer (trademark: SUPER HIGH PRESSURE TYPE HOMOGENIZER GM-1, made by SMT COMPANY) under a pressure of 500 kg/cm$^2$. The resultant aqueous dispersion contained fine silica particles having a decreased average secondary particle size of 50 nm and a non-changed average primary particle size of 15 nm, in a dry solid content of 12%.

[Fine silica particles B]

An aqueous dispersion of synthetic amorphous silica particles (trademark: NIPSIL HD-2, made by NIPPON SILICA INDUSTRIAL CO., LTD.) having an average secondary particle size of 3 $\mu$m and an average primary particle size of 11 nm, was subjected to repeated pulverizing and dispersing operations in a pressure type homogenizer (trademark: SUPER HIGH PRESSURE TYPE HOMOGENIZER GM-1, made by SMT COMPANY) under a pressure of 500 kg/cm$^2$. The resultant aqueous dispersion contained fine silica particles having a decreased average secondary particle size of 200 nm and a non-changed average primary particle size of 11 nm, in a dry solid content of 12%.

[Fine silica particles C]

An aqueous dispersion of synthetic amorphous silica particles (trademark: NIPSIL LP, made by NIPPON SILICA INDUSTRIAL CO., LTD.) having an average secondary particle size of 9 μm and an average primary particle size of 16 nm, was subjected to repeated pulverizing and dispersing operations in a pressure type homogenizer (trademark: SUPER HIGH PRESSURE TYPE HOMOGENIZER GM-1, made by SMT COMPANY) under a pressure of 500 kg/cm$^2$. The resultant aqueous dispersion contained fine silica particles having a decreased average secondary particle size of 500 nm and a non-changed average primary particle size of 16 nm, in a dry solid content of 12%.

Casting Drum

In the formation of each cast-coated layer, a casting drum having a peripheral surface formed by plating a steel drum periphery with nickel and further with chromium and polishing the plated surface and having a surface roughness Ra of 0.03 μm, was used.

Example 1

A surface of the above-mentioned substrate sheet was coated with a coating liquid, having the composition shown below and a solid content of 17% by using an air knife coater, and dried, to form an undercoat layer having a dry weight of 12 g/m$^2$.

Composition of Coating Liquid for Undercoat Layer (Solid content: 17%)

| Component | Part |
|---|---|
| Synthetic amorphous silica particles(*)1 | 80 |
| Zeolite(*)2 | 20 |
| Silyl-modified polyvinyl alcohol(*)3 | 20 |
| Emulsion of colloidal silica composite product(*)4 | 40 |
| Fluorescent brightening agent(*)5 | 2 |

Note:
(*)1Trademark: FINESIL X-60, made by TOKUYAMA K.K. Average secondary particle size: 6.0 μm Average primary particle size: 15 nm
(*)2Trademark: TOYOBUILDER, made by TOSO K.K. Average particle size: 1.5 μm
(*)3Trademark: R 1130, made by KURARAY CO., LTD., Degree of polymerization: 1300, Degree of saponification: 98 or more
(*)4An aqueous emulsion of a composite product of a styrene-2-methylhexyl acrylate copolymer having a glass-transition temperature of 75° C. with colloidal silica particles having a particle size of 30 nm in a weight ratio of the copolymer to the colloidal silica of 40/60, the composite product being in the form of fine particles having a particle size of 80 nm
(*)5Trademark: WHITEX BPSH, made by SUMITOMO CHEMICAL CO., LTD.

The undercoat layer was coated with a coating liquid, for a cast-coated layer, having the composition shown below and a solid content of 12% by using an air knife coater, the resultant coating liquid layer was semi-dried by blowing cold air for 20 seconds, the semi-dried coating layer, which had a water content of 150% based on the dry weight of the coating layer, was press-cast onto the mirror-finished surface of the casting drum heated at a surface temperature of 90° C., and dried on the casting surface to form a cast-coated layer, and the resultant laminate was separated from the casting drum.

Composition of Coating Liquid for Cast-coated Layer (Solid content: 12%)

| Component | Part |
|---|---|
| Fine silica particles A | 100 |
| Dialkyldimethyl ammonium chlorideacrylamide copolymer(*)6 | 10 |
| Cationic acrylic resin(*)7 | 20 |
| Silyl-modified polyvinyl alcohol(*)8 | 10 |
| Releasing agent(*)9 | 2 |

Note:
(*)6. . . Trademark: PAS-J-81, made by NITTO BOSEKI CO., LTD.
(*)7. . . Trademark: XC-2010 (quaternary ammonium salt-modified aqueous acrylic resin), made by SEIKO KAGAKU K.K., Tg: 85° C.
(*)8. . . Trademark: R 1130, made by KURARAY CO., LTD.
(*)9. . . Lecithin A high gloss ink jet recording sheet was obtained. In this recording sheet, the cast-coated layer was in a dry weight of 5 g/m$^2$.

Example 2

An ink jet recording sheet was produced by coating a surface of the substrate sheet with the same coating liquid for an undercoat layer as in Example 1 by using an air knife coater; drying the resultant coating liquid layer to form an undercoat layer having a dry weight of 12 g/m$^2$; coating the resultant undercoat layer surface with the same coating liquid for a cast-coated layer as in Example 1; immediately press-casting the resultant coating liquid layer onto the mirror-finished surface of the casting drum heated to a surface temperature of 90° C.; drying the casted coating layer; and separating the resultant laminate from the casting drum.

In the resultant ink jet recording sheet, the dry weight of the cast-coated layer was 2 g/m$^2$.

Example 3

A high gloss ink jet recording sheet was produced by the same procedures as in Example 1, except that the coating liquid for the undercoat layer had the composition as shown below and a solid content of 18%.

Composition of Coating Liquid for Undercoat Layer (Solid content: 18%)

| Component | Part |
|---|---|
| Synthetic amorphous silica particles(*)1 | 80 |
| Zeolite(*)2 | 20 |
| Silyl-modified polyvinyl alcohol(*)3 | 20 |
| Emulsion of colloidal silica composite product(*)4 | 40 |
| Fluorescent brightening agent(*)5 | 2 |
| Diallyldimethyl ammonium chloride-acrylamide copolymer(*)6 | 10 |

Example 4

A high gloss ink jet recording sheet was produced by the same procedures as in Example 1, except that in the coating liquid for the cast-coated layer, the fine silica particles A were replaced by the fine silica particles B.

Example 5

A high gloss ink jet recording sheet was produced by the same procedures as in Example 1, except that the coating liquid for the undercoat layer and the coating liquid for the cast-coated layer had the compositions as shown below, respectively.

Composition of Coating Liquid for Undercoat Layer (Solid content: 17%)

| Component | Part |
|---|---|
| Synthetic amorphous silica particles(*)1 | 80 |
| Zeolite(*)2 | 20 |
| Silyl-modified polyvinyl alcohol(*)3 | 20 |
| Emulsion of colloidal silica composite product(*)4 | 40 |
| Fluorescent brightening agent(*)5 | 2 |
| Diallyldimethyl ammonium chloride-acrylamide copolymer(*)6 | 10 |

Composition of coating liquid for cast-coated layer (Solid content: 12%)

| Component | Part |
|---|---|
| Fine silica particles A | 100 |
| Silyl-modified polyvinyl alcohol(*)3 | 20 |
| Releasing agent(*)9 | 2 |

Example 6

A high gloss ink jet recording sheet was produced by the same procedures as in Example 1, except that the coating liquid for the undercoat layer was replaced by one having the following composition.

Composition of Coating Liquid for Undercoat Layer (Solid content: 17%)

| Component | Part |
|---|---|
| Synthetic amorphous silica particles(*)1 | 80 |
| Zeolite(*)2 | 20 |
| Silyl-modified polyvinyl alcohol(*)3 | 20 |
| Fluorescent brightening agent(*)5 | 2 |

Example 7

A high gloss ink jet recording sheet was produced by the same procedures as in Example 1 with the following exceptions.

No undercoat layer was formed on the substrate sheet.

The same coating liquid for the cast-coated layer as in Example 1 was directly coated on the substrate surface by using the air knife coater; the resultant coating liquid layer was semi-dried by blowing cold air thereto for 20 seconds; the semi-dried coating layer having a water content of 150% based on the dry weight of the cast-coated layer was press-cast onto the mirror-finished surface of the casting drum heated to a surface temperature of 100° C., and dried to form a cast-coated layer; and the resultant laminate was separated from the casing drum.

In the resultant ink jet recording sheet, the cast-coated layer was in an amount of 10 g/m$^2$.

Comparative Example 1

An ink jet recording sheet was produced by the same procedures as in Example 1, except that in the coating liquid for the cast-coated layer, the fine silica particles A was replaced by the fine silica particles C.

Comparative Example 2

An ink jet recording sheet was produced by the same procedures as in Example 1 with the following exceptions.

The undercoat layer produced in the same manner as in Example 1 was coated with a coating liquid for a cast-coated layer, having the composition as shown below and a solid content of 25%, by using a roll coater.

| Coating liquid composition for cast-coated layer | Part |
|---|---|
| Emulsion of colloidal silica composite product(*)4 | 100 |
| A thickening and dispersing agent(*)10 | 5 |
| Releasing agent(*)9 | 3 |

Note:
(*)10. . . Alkylvinylether-maleic acid derivative copolymer

In the colloidal silica composite product, the colloidal silica particles were in the form of primary particles which did not agglomerate with each other.

Immediate after the coating with the coating liquid for the cast-coated layer, the resultant coating liquid layer was press-casted onto a mirror-finished peripheral surface of a casting drum heated to a surface temperature of 85° C. and dried. After drying, the resultant laminate was separated from the casting drum to obtain an ink jet recording sheet in which the cast-coated layer was in a dry weight of 6 g/m$^2$.

Comparative Example 3

An ink jet recording sheet was produced by the same procedures as in Example 1, except that the formation of the cast-coated layer was omitted. Namely, this recording sheet consisted of only the substrate sheet and the undercoat layer.

Comparative Example 4

An ink jet recording sheet was produced by the same procedures as in Example 3, except that the formation of the cast-coated layer was omitted. Namely the resultant recording sheet consisted of only the substrate sheet and the undercoat layer.

Comparative Example 5

The substrate sheet per se was employed as an ink jet recording sheet.

Example 8

A high gloss ink jet recording sheet was produced by the same procedures as in Example 1 with the following exceptions.

The undercoat layer formed on the substrate sheet by the same procedures as in Example 1 was coated with a coating liquid for a cast-coated layer, having the composition shown below and a solid content of 12%, by using an air knife coater.

Coating Liquid Composition (solid content: 12%) for Cast-coated Layer

| Component | Part |
|---|---|
| Fine silica particles (A) | 100 |
| Diallyldimethyl ammonium chlorideacrylamide copolymer(*)6 | 10 |
| Cationic aqueous urethane resin(*)11 | 25 |
| Releasing agent(*)9 | 1 |

Note:
(*)11. . . Trademark: F-8554D, made by DAIICHI KOGYOSEIYAKU K.K., Tg: 73° C.

The resultant coating layer for the cast-coated layer was semi-dried by blowing cold air for 20 seconds to such an extent that the semi-dried coating liquid had a water content of 150% based on the bone dry weight of the cast-coated layer. The semi-dried coating liquid was press-casted onto a mirror-finished peripheral surface of a casting drum heated to a surface temperature of 100° C., and dried. After drying, the resultant laminate was separated from the casting drum. In the resultant high gloss ink jet recording sheet, the cast-coated layer was in a dry weight of 6 g/m$^2$.

Example 9

A high gloss ink jet recording sheet was produced by the same procedures as in Example 8 with the following exceptions.

In the preparation of the coating liquid (solid content: 12%) for the cast-coated layer, the cationic aqueous urethane resin (F-8554D)(*)11 was replaced by another cationic aqueous urethane resin (trademark: Patelacol SH 3202, made by DAINIPPON INK KOGYO K.K., Tg: −20° C.)(*)12.

Example 10

A high gloss ink jet recording sheet was produced by the same procedures as in Example 8 with the following exceptions.

The coating liquid for the cast-coated layer had the composition shown below and a solid content of 12%.

Composition of Coating Liquid (solid content: 12%) for Cast-coated Layer

| Component | Part |
|---|---|
| Fine silica particles (A) | 100 |
| Anionic aqueous urethane resin(*)13 | 25 |
| Releasing agent(*)9 | 1 |

Note:
(*)13. . . Trademark: SUPERFLEX 126, made by DAIICHI KOGYOSEIYAKU K.K., Tg: 72° C.

Example 11

A high gloss ink jet recording sheet was produced by the same procedures as in Example 8 with the following exceptions.

The coating liquid for the cast-coated layer had the following composition and a solid content of 12%.

Composition of Coating Liquid (solid content: 12%) for Cast-coated Layer

| Component | Part |
|---|---|
| Fine silica particles (A) | 100 |
| Anionic aqueous urethane resin(*)14 | 25 |
| Releasing agent(*)9 | 1 |

Note:
(*)14. . . Trademark: SUPERFLEX 150 D, made by DAIICHI KOGYOSEIYAKU K.K., Tg: 22° C.

Example 12

A high gloss ink jet recording sheet was produced by the same procedures as in Example 8 with the following exceptions.

The coating liquid for the cast-coated layer had the following composition and a solid content of 12%.

Composition of Coating Liquid (solid content: 12%) for Cast-coated Layer

| Component | Part |
|---|---|
| Fine silica particles (A) | 100 |
| Anionic aqueous urethane resin(*)15 | 25 |
| Releasing agent(*)9 | 1 |

Note:
(*)15. . . Trademark: VYLONAL MD 1400, made by TOYOBO K.K., Tg: 23° C.

Example 13

A high gloss ink jet recording sheet was produced by the same procedures as in Example 8 with the following exceptions.

The coating liquid for the cast-coated layer had the following composition and a solid content of 12%.

Composition of Coating Liquid (solid content: 12%) for Cast-coated Layer

| Component | Part |
|---|---|
| Fine silica particles (A) | 100 |
| Anionic aqueous urethane resin(*)16 | 25 |
| Releasing agent(*)9 | 1 |

Note:
(*)16. . . Trademark: JONCRYL 7001, made by JOHNSON POLYMER K.K., Tg: 12° C.

Example 14

A high gloss ink jet recording sheet was produced by the same procedures as in Example 8 with the following exceptions.

The coating liquid for the cast-coated layer had the following composition and a solid content of 12%.

Composition of Coating Liquid (solid content: 12%) for Cast-coated Layer

| Component | Part |
|---|---|
| Fine silica particles A | 100 |
| Diallyldimethyl ammonium chloride-acrylamide copolymer(*)6 | 10 |
| Cationic aqueous urethane resin(*)28 | 25 |
| Stearic acid amide | 5 |

Note:
(*)28. . . Trademark: F-8564D, made by DAIICHI KOGYOSEIYAKU K.K. Tg: 73° C.

Example 15

A high gloss ink jet recording sheet was produced by the same procedures as in Example 8 with the following exceptions.

The coating liquid for the cast-coated layer had the following composition and a solid content of 12%.

Composition of Coating Liquid (solid content: 12%) for Cast-coated Layer

| Component | Part |
|---|---|
| Fine silica particles A | 100 |
| Diallyldimethyl ammonium chloride-acrylamide copolymer(*)6 | |
| Cationic aqueous urethane resin(*)28 | 25 |
| Oleic acid amide | 5 |

Example 16

A high gloss ink jet recording sheet was produced by the same procedures as in Example 8 with the following exceptions.

The coating liquid for the cast-coated layer had the following composition and a solid content of 12%.

Composition of Coating Liquid (solid content: 12% for Cast-coated Layer

| Component | Part |
|---|---|
| Fine silica particles A | 100 |
| Diallyldimethyl ammonium chloride-acrylamide copolymer(*)6 | 10 |
| Cationic aqueous urethane resin(*)28 | 25 |
| A mixture of polyethylene was with stearic acid amide(*)17 | 10 |

Note:
(*)17. . . Trademark: PERTOL N856, made by KINDAI KAGAKUKOGYO K.K.

Example 17

A high gloss ink jet recording sheet was produced by the same procedures as in Example 8 with the following exceptions.

The coating liquid for the cast-coated layer had the following composition and a solid content of 12%.

Composition of Coatinq Liquid (solid content: 12%) for Cast-coated Layer

| Component | Part |
|---|---|
| Fine silica particles (A) | 100 |
| Anionic aqueous urethane resin(*)18 | 25 |
| Stearic acid amide | 5 |

Note:
(*)18. . . Trademark: SUPERFLEX 126, made by DAIICHI KOGYOSEIYAKU K.K., Tg: 72° C.

Example 18

A high gloss ink jet recording sheet was produced by the same procedures as in Example 8 with the following exceptions.

The coating liquid for the cast-coated layer had the following composition and a solid content of 12%.

Composition of Coating Liquid (solid content: 12%) for Cast-coated Layer

| Component | Part |
|---|---|
| Fine silica particles A | 100 |
| Diallyldimethyl ammonium chloride-acrylamide copolymer(*)6 | |
| Cationic aqueous urethane resin(*)28 | 25 |
| Releasing agent(*)9 | 5 |

Example 19

A high gloss ink jet recording sheet was produced by the same procedures as in Example 8 with the following exceptions.

The coating liquid for the cast-coated layer had the following composition and a solid content of 12%.

Composition of Coating Liquid (solid content: 12%) for Cast-coated Layer

| Component | Part |
|---|---|
| Fine silica particles A | 100 |
| Diallyldimethyl ammonium chloride-acrylamide copolymer(*)6 | |
| Cationic aqueous urethane resin(*)28 | 25 |
| Releasing agent(*)19 | |

Note:
(*)19Calcium stearate

In each of the resultant ink jet recording sheets of Examples 1 to 19 and Comparative Examples 1 to 4, the ink jet recording aptitude, while sheet gloss, and casting surface-releasing property were measured and evaluated by the following testing methods.

[Ink jet recording aptitude]

A sample of each of the ink jet recording sheets was subjected to an ink jet recording procedure by using an ink jet printer (model: BJC600J made by CANON K.K., or BJC 420J made by CANON K.K.)

[Uniformity of solid printed images]

A solid print image was formed by a mixed ink of a cyan-colored ink with a magenta-colored ink, and the uniformity in color density was evaluated, by naked eye, into the following classes

| Class | Uniformity |
|---|---|
| 3 | No unevenness in color density is found. Excellent |
| 2 | Slight color density unevenness is formed. In practice, some difficulty occurs |
| 1 | Significant unevenness in color density is found. Practical employment is quite difficult. |

[Resistance to ink-blotting]

Black, cyan, magenta and yellow colored inks were solid printed in such a manner that the printed areas of the above-mentioned colored inks come into contact at edges thereof with edges of other printed ink areas. The blotting of the inks into each other was observed by the naked eye and evaluated as follows.

| Class | Ink blotting |
|---|---|
| 2 | No blotting is found |
| 1 | Slightly blotting is found Practically usable |

[Drying property of ink]

A solid printed images were formed from a mixture of a cyan-colored ink and a magenta-colored ink, and the drying property of the solid printed images was evaluated as follow.

| Class | Ink drying property |
|---|---|
| 2 | Even immediately after printing, no ink is transferred from the printed ink images to a finger touched to the ink images. |
| 1 | Immediate after printing, ink is transferred from the printed ink images to a finger touched to the ink images. |

[Color density of ink jet recorded images]

A color density of black colored solid ink images was measured by MACBETH RD-914.

[Gloss]

A white sheet gloss was measured in accordance with JIS P 8142 at an angle of 75 degrees.

[Appearance by the naked eye observation]

The gloss and visual smoothness were evaluated, by naked eye, as follows.

| Class | Gloss and Smoothness |
|---|---|
| 4 | Excellent |
| 3 | Satisfactory |
| 2 | Slightly unsatisfactory |
| 1 | Unsatisfactory |

[Casting drum releasing property]

When a cast-coated layer is formed on a casting drum peripheral surface, the staining of the casting drum and ease of release of the resultant cast-coated layer from the casting drum were evaluated, by naked eye, in the following classes.

| Class | Releasing property |
|---|---|
| 3 | No problem occurs in cast-coating and releasing procedures. |
| 2 | Substantially no problem occurs in cast-coating procedure, but the releasing property is slightly insufficient. |
| 1 | Slightly poor cast-coating and releasing properties, usable in practice. |

[General evaluation]

The grade of the printed ink images and the gloss are generally evaluated as follows.

| Class | Image grade and gloss |
|---|---|
| 5 | Very excellent |
| 4 | Excellent |
| 3 | Satisfactory |
| 2 | Slightly unsatisfactory |
| 1 | Unsatisfactory |

The test results are shown in Tables 1, 2 and 3.

TABLE 1

| | | Item | | | | | |
|---|---|---|---|---|---|---|---|
| | | Ink jet recording aptitude (1) | | | | | |
| Example No. | | Uniformity of solid printed ink images | Ink-drying property | Color density of ink images | Gloss (75 degree) | Appearance | General evaluation |
| Example | 1 | 3 | 2 | 2.4 | 60 | 4 | 5 |
| | 2 | 3 | 2 | 2.1 | 50 | 3 | 4 |
| | 3 | 3 | 2 | 1.9 | 45 | 2 | 3 |
| | 4 | 3 | 2 | 2.2 | 40 | 2 | 3 |
| | 5 | 3 | 2 | 1.8 | 45 | 2 | 3 |
| | 6 | 3 | 2 | 2.2 | 50 | 3 | 4 |
| | 7 | 1–2 | 2 | 2.0 | 45 | 2 | 3 |
| Comparative | 1 | 3 | 2 | 1.8 | 30 | 2 | 2 |
| Example | 2 | 3 | 2 | 1.5 | 70 | 3 | 2 |

TABLE 1-continued

| Example No. | Item | | | | | |
|---|---|---|---|---|---|---|
| | Ink jet recording aptitude (1) | | | | | |
| | Uniformity of solid printed ink images | Ink-drying property | Color density of ink images | Gloss (75 degree) | Appearance | General evaluation |
| 3 | 2 | 2 | 1.2 | 5 | 1 | 1 |
| 4 | 3 | 2 | 1.5 | 5 | 1 | 1 |
| 5 | 1 | 2 | 1.0 | 7 | 1 | 1 |

Note: Printer (1): BJC600J

TABLE 2

| Example No. | Item | | | | | |
|---|---|---|---|---|---|---|
| | Ink jet recording aptitude (2) | | | | | |
| | Uniformity of solid printed ink images | Ink-drying property | Color density of ink images | Gloss | Appearance | General evaluation |
| Example 8 | 3 | 2 | 2.4 | 55 | 4 | 5 |
| 9 | 3 | 2 | 2.3 | 55 | 4 | 5 |
| 10 | 3 | 2 | 1.7 | 40 | 2–3 | 4 |
| 11 | 3–2 | 2 | 1.7 | 40 | 2–3 | 4 |
| 12 | 2 | 2 | 1.5 | 40 | 2–3 | 3 |
| 13 | 2 | 2 | 1.5 | 40 | 2–3 | 3 |

Note: Printer (2): BJC420J

TABLE 3

| Example No. | Item | | | | | | | |
|---|---|---|---|---|---|---|---|---|
| | Ink jet recording aptitude (2) | | | | | | | |
| | Uniformity of solid printed ink images | Resistance to blotting | Ink drying property | Color density of ink images | Gloss | Appearance | Releasing property | General evaluation |
| Example 14 | 3 | 2 | 2 | 2.1 | 55 | 4 | 3 | 5 |
| 15 | 3 | 2 | 2 | 2.1 | 55 | 4 | 3 | 5 |
| 16 | 3 | 2 | 2 | 2.1 | 55 | 4 | 3 | 5 |
| 17 | 3 | 1 | 2 | 1.8 | 40 | 2–3 | 3–2 | 4 |
| 18 | 2 | 1 | 2 | 1.9 | 40 | 2–3 | 1 | 3 |
| 19 | 2 | 1 | 2 | 1.9 | 40 | 2–3 | 1 | 3 |

Note: Printer (2): BJC420J

In the following Examples II-1 to II-4, the same fine silica particles A, B, and C as mentioned above were employed.

When one of the fine silica particles A, B and C was mixed with a cationic compound, the resultant mixture is pulverized by a pressure type homogenizer (trademark: Super high pressure type homogenizer GM-1, made by SMT COMPANY) under a pressure of 500 kg/cm$^2$, until the average secondary particle size of the mixture reaches the original level of the silica secondary particles A, B or C. The primary particle size of the fine silica particles is not changed by the mixing with the cationic compound and by the pulverizing.

Example II-1

A surface of the above-mentioned substrate sheet was coated with a coating liquid having the composition shown below and a solid content of 17% by using an air knife coater, and dried, to form an undercoat layer having a dry weight of 10 g/m$^2$.

Composition of coating liquid for undercoat layer (solid content: 17%)

| Component | Part |
|---|---|
| Synthetic amorphous silica particles(*)21 | 80 |
| Zeolite(*)22 | 20 |
| Silyl-modified polyvinyl alcohol(*)23 | 20 |
| Emulsion of colloidal silica composite | 40 |

-continued

| Component | Part |
|---|---|
| product(*)24 | |
| Fluorescent brightening agent(*)25 | 2 |

Note:
(*)21Trademark: FINESIL X-45, made by TOKUYAMA K.K. Average secondary particle size: 4.5 μm Average primary particle size: 15 nm
(*)22Trademark: TOYOBUILDER, made by TOSO K.K. Average particle size: 1.5 μm
(*)23Trademark: R 1130, made by KURARAY CO., LTD.
(*)24An aqueous emulsion of a composite product of a styrene-2-methylhexyl acrylate copolymer having a glass-transition temperature of 75° C. with colloidal silica particles having a particle size of 30 nm in a weight ratio of the copolymer to the colloidal silica of 40/60, the composite product being in the form of fine particles having a particle size of 80 nm.
(*)25Trademark: WHITEX BPSH, made by SUMITOMO CHEMICAL CO., LTD.

The undercoat layer was coated with a coating liquid for a cast-coated layer, having the composition shown below and a solid content of 12% by using an air knife coater, the resultant coating liquid layer was semi-dried by blowing cold air for 20 seconds, the semi-dried coating layer, which had a water content of 150% based on the dry weight of the coating layer, was press-cast onto the mirror-finished surface of the casting drum heated at a surface temperature of 90° C., and dried on the casting surface to form a cast-coated layer, and the resultant laminate was separated from the casting drum.

Composition of Coating Liquid for Cast-coated Layer (Solid content: 12%)

| Component | Part |
|---|---|
| Fine silica particles A | 100 |
| Diallkyldimethyl ammonium chloride-acrylamide copolymer(*)26 | 10 |
| Cationic aqueous urethane resin(*)27 | 25 |
| Stearic acid amide | 5 |

Note:
(*)26Trademark: PAS-J-81, made by NITTO BOSEKI K.K.
(*)27Trademark: F-8564D, made by DAIICHI KOGYOSEIYAKU K.K., Tg: 73° C.

A high gloss ink jet recording sheet was obtained. In this recording sheet, the cast-coated layer had a dry weight of 4 g/m$^2$.

Example II-2

A high gloss ink jet recording sheet was produced by the same procedures as in Example II-1, except that in the preparation of the coating liquid for the undercoat layer, the synthetic amorphous silica particles(*)21 (Finesil X-45) was replaced by another synthetic amorphous silica particles(*)28(trademark: Finesil X-37, made by TOKUYAMA K.K.) having an average secondary particle size of 2.5 μm and an average primary particle size of 15 nm.

Example II-3

A high gloss ink jet recording sheet was produced by the same procedures as in Example II-1, except that in the preparation of the coating liquid for the undercoat layer, the synthetic amorphous silica particles(*)21 (Finesil X-45) was replaced by another synthetic amorphous silica particles(*)29 (trademark: Finesil X-12, made by TOKUYAMA K.K.) having an average secondary particle size of 12.5 μm and an average primary particle size of 15 nm.

Example II-4

A high gloss ink jet recording sheet was produced by the same procedures as in Example II-1, except that in the preparation of the coating liquid for the undercoat layer, the synthetic amorphous silica particles(*)21 (Finesil X-45) was replaced by another synthetic amorphous silica particles(*)30 (trademark: Finesil F-80, made by TOKUYAMA K.K.) having an average secondary particle size of 1.5 μm and an average primary paticle size of 15 nm.

In each of the resultant ink jet recording sheets of Examples II-1 to II-4, the ink jet recording ability, white sheet gloss, and casting surface-releasing property were measured and evaluated by the following testing methods.

[Ink jet recording aptitude]

A sample of each of the ink jet recording sheets was subjected to an ink jet recording procedure by using an ink jet printer (model: BJC600J made by Canon K.K.)

[Uniformity of solid printed images]

A solid print image was formed by a mixed ink of a cyan-colored ink with a magenta-colored ink, and the uniformity in color density was evaluated, by naked eye, into the following classes

| Class | Uniformity |
|---|---|
| 3 | No unevenness in color density is found. Excellent |
| 2 | Slight color density unevenness is formed. Usable in practice |
| 1 | Significant unevenness in color density is found. Practical employment is quite difficult. |

[Resistance to blotting of ink]

A cyan-colored ink and a magenta colored ink were solid printed in such a manner that the printed cyane-colored ink area comes into contact at an edge thereof with an edge of the printed magenta colored ink area. The blotting of the cyan-and magenta-colored inks into each other was observed by the naked eye and evaluated as follows.

| Class | Ink-blotting |
|---|---|
| 4 | No blotting is found<br>Excellent |
| 3 | Very slight blotting is formed<br>Particularly satisfactory |
| 2 | Blotting is found<br>Practically difficult to use |
| 1 | Severe blotting is found<br>Practically useless |

[Drying property of ink]

A solid printed images were formed from a mixture of a cyan-colored ink and a magenta-colored ink, and the drying property of the solid printed images was evaluated as follow.

| Class | Ink drying property |
|---|---|
| 3 | Even immediately after printing, no ink is transferred from the printed ink images to a finger touched to the ink images. |
| 2 | Immediately after printing, the |

-continued

| Class | Ink drying property |
|---|---|
| | printed ink slightly transfers from the ink images to a finger touched to the ink image. Practically no problem. |
| 1 | Immediately after printing, ink is transferred from the printed ink images to a finger touched to the ink images. |

[Color density of ink jet recorded images]

A color density of black colored solid ink images was measured by MACBETH RD-914.

[Gloss]

A white sheet gloss was measured in accordance with JIS P 8142 at an angle of 75 degrees.

[Appearance by the naked eye observation]

The gloss and visual smoothness were evaluated, by naked eye, as follows.

| Class | Gloss and Smoothness |
|---|---|
| 4 | Excellent |
| 3 | Satisfactory |
| 2 | Slightly poor, practically usable |
| 1 | Unsatisfactory |

The test results are shown in Table 4.

TABLE 4

| | | Item | | | | | |
|---|---|---|---|---|---|---|---|
| | | Ink jet recording aptitude (2) | | | | | |
| Example No. | | Uniformity of solid printed ink images | Resistance to blotting | Ink drying property | Color density of ink images | Gloss | Appearance |
| Example | II-1 | 3 | 4 | 3 | 2.20 | 50 | 3 |
| | II-2 | 3 | 3 | 3 | 2.10 | 55 | 4 |
| | II-3 | 2 | 4 | 3 | 2.30 | 35 | 2 |
| | II-4 | 2 | 2 | 2 | 1.90 | 60 | 4 |

The examples in accordance with the present invention clearly show that the ink jet recording sheets of the present invention exhibit excellent ink-drying property appearance and gloss and a superior ink jet recording ability including a high color density, uniformity and clarity of the ink images.

What is claimed is:

1. An ink jet recording sheet comprising a substrate sheet, an undercoat layer formed on a surface of the substrate sheet and a cast-coated layer formed on the undercoat layer, wherein the undercoat layer comprises a pigment comprising at least one member selected from the group consisting of amorphous silica, alumina and zeolite pigments and a binder formed from a polyurethane resin dispersed in an aqueous medium, and is ink-absorbing, and the cast-coated layer comprises fine silica particles having an average primary particle size of 3 to 40 nm and an average secondary particle size of 10 to 300 nm.

2. The ink jet recording sheet as claimed in claim 1, wherein the cast-coated layer further comprises a cationic compound.

3. The ink jet recording sheet as claimed in claim 1, wherein the undercoat layer comprises no cationic compound and the cast-coated layer further comprises a cationic compound.

4. The ink jet recording sheet as claimed in claim 1, wherein the cast-coated layer is one prepared by coating a coating liquid for the cast-coated layer on a surface of the undercoat layer formed on the substrate sheet; press-casting, while the resultant coating liquid layer on the undercoat layer surface is kept in a wetted condition, the coating liquid layer onto a mirror-finished peripheral surface of a casting drum; drying the press-casted coating liquid layer on the casting drum; and separating the resultant laminate from the casting drum.

5. The ink jet recording sheet as claimed in claim 1, wherein the cast-coated layer is one prepared by coating a coating liquid for the cast-coated layer on a surface of the undercoat layer formed on the substrate sheet; drying the coating liquid layer on the undercoat layer; wetting the dried coating layer with a wetting liquid; press-casting, while the wetted coating layer is kept in a wetted condition, the wetted coating layer onto a mirror-finished peripheral surface of a casting drum; drying the press-casted coating layer on the casting drum; and separating the resultant laminate from the casting drum.

6. The ink jet recording sheet as claimed in claim 1, wherein the undercoat layer comprises a composite product of a polymer of a monomer having an ethylenically unsaturated group with a colloidal silica.

7. The ink jet recording sheet as claimed in claim 1, wherein the polyurethane resin contained in the cast-coated layer comprises a cationic polyurethane resin.

8. The ink jet recording sheet as claimed in claim 1, wherein the polyurethane resin contained in the cast-coated layer has a glass transition temperature of 40° C. or more.

9. The ink jet recording sheet as claimed in claim 1, wherein the cast-coated layer further contains a higher fatty acid amide.

10. The ink jet recording sheet as claimed in claim 1, wherein the pigment contained in the undercoat layer comprises amorphous silica particles having an average secondary particle size of 2 $\mu$m to 8 $\mu$m.

11. A process for producing the ink jet recording sheet as claimed in claim 1, which comprises;

forming an undercoat layer on a surface of the substrate sheet;

coating a coating liquid for the cast-coated layer on a surface of the undercoat layer;

semi-drying the coating liquid layer on the undercoat layer surface;

press-casting the semi-dried coating layer onto a mirror-finished peripheral surface of a casting drum;

drying the press-casted coating layer on the casting drum; and separating the resultant laminate from the casting drum.

12. The process as claimed in claim 11, wherein the semi-dried coating layer contains water in an amount of 20 to 400 parts by weight per 100 parts by weight of a total solid content in the semi-dried coating layer.

* * * * *